US008381714B2

(12) United States Patent
Shaffer et al.

(10) Patent No.: US 8,381,714 B2
(45) Date of Patent: Feb. 26, 2013

(54) BURNER FOR COOKING APPLIANCES

(75) Inventors: Timothy Scott Shaffer, LaGrange, KY (US); Mark Davis Johnson, Louisville, KY (US); Derek Lee Watkins, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 680 days.

(21) Appl. No.: 12/613,772

(22) Filed: Nov. 6, 2009

(65) Prior Publication Data

US 2011/0108016 A1 May 12, 2011

(51) Int. Cl.
*F24C 3/12* (2006.01)

(52) U.S. Cl. ..... 126/39 E; 126/39 R; 431/8; 431/350; 431/354

(58) Field of Classification Search ..... 126/39 E, 126/39 R; 431/8, 286, 350, 354; 239/558, 239/559
See application file for complete search history.

(56) References Cited

U.S. PATENT DOCUMENTS

| | | | | |
|---|---|---|---|---|
| 5,800,159 | A | 9/1998 | Maughan et al. | |
| 5,899,681 | A | 5/1999 | Maughan | |
| 6,332,460 | B1 | 12/2001 | Paesani | |
| 6,607,378 | B2 * | 8/2003 | Harneit et al. | 431/354 |
| 7,291,009 | B2 | 11/2007 | Kamal et al. | |

* cited by examiner

*Primary Examiner* — Alfred Basichas
(74) *Attorney, Agent, or Firm* — Global Patent Operation; Douglas D. Zhang

(57) ABSTRACT

A gas burner for a cooking appliance having a base portion and a side wall extending from the base portion. A cap is disposed on the side wall. The cap includes a substantially conical interior surface facing the base portion. The substantially conical interior surface is configured to substantially eliminate creation of turbulent flow eddies in a gaseous fuel mixture passing through the gas burner.

20 Claims, 7 Drawing Sheets

BURNER FOR COOKING APPLIANCES

BACKGROUND OF THE INVENTION

The present invention relates generally to cooking appliances and in particular to gas burners for cooking appliances.

Generally gas of cooking appliances must meet various industry regulations (e.g. fabric ignition, carbon monoxide, carbon deposit, rapid door closure, etc.) to obtain agency certifications. Meeting these industry regulations can have an impact on the efficiency of the burners. Using conventional design practices, increasing the maximum burner rating while staying within industry regulation tends to adversely impact or compromise burner efficiency. For example, a typical 18,000 Btu/hr burner may meet industry regulations, but have an efficiency of about 30% when compared to lower rated burners which may have efficiencies of about 40%. In addition to the drops in efficiency, the flexibility to use the burners with smaller pots is adversely affected and usually requires the user of the cooking appliance to decrease the gas flow to the burner to avoid flames from excessive travelling up the side of the pot.

A gas flame that has about 100% primary air is stable, produces substantially no carbon monoxide and does not reach outward (e.g. towards edges of a utensil) to obtain additional air when utensils or cookware are placed over the burner. As the primary air percentage decreases, secondary air flow paths must be established to complete the combustion or large carbon monoxide spikes can occur. Generally, conventional gas burners have a primary air percentage as low as about 20% to about 30%. Lower primary air percentages adversely affect the ability to pass tests corresponding to the above-noted industry regulations. Typically, the burner size is increased to compensate for the lower primary air percentages.

It would be advantageous to be able to provide smaller burners that allow for greater efficiency and primary air entrainment percentages while meeting industry regulations.

BRIEF DESCRIPTION OF THE INVENTION

As described herein, the exemplary embodiments overcome one or more of the above or other disadvantages known in the art.

One aspect of the exemplary embodiments relates to a gas burner for a cooking appliance. The gas burner includes a burner body having a base portion and a side wall extending from the base portion. A cap is disposed on the side wall. The cap includes a substantially conical interior surface facing the base portion. The substantially conical interior surface is configured to substantially eliminate creation of turbulent flow eddies in a gaseous fuel mixture passing through the gas burner.

Another aspect of the exemplary embodiments relates to a gas burner for a cooking appliance. The gas burner includes a burner body having a base portion, a side wall extending from the base portion and a cap disposed on the side wall to form a fuel chamber within the burner body. A plurality of burner ports extend through at least one of the side wall and cap where the plurality of burner ports are sized and spaced to minimize an outer diameter of the gas burner.

Still another aspect of the disclosed embodiments relates to a cooking appliance. The cooking appliance includes a cooktop and at least one gas burner disposed at least partly on the cooktop. The gas burner includes a burner body having a base portion, a side wall extending from the base portion and a cap disposed on the side wall. The cap includes a substantially conical interior surface facing the base portion. The substantially conical interior surface is configured to substantially eliminate the creation of turbulent flow eddies in a gaseous fuel mixture passing through the gas burner.

These and other aspects and advantages of the exemplary embodiments will become more apparent from the following detailed description considered in conjunction with the accompanying drawings. It is to be understood, however, that the drawings are designed solely for the purposes of illustration and not as a definition of the limits of the invention, for which reference should be made to the appended claims. Moreover, the drawings are not necessarily to scale and that, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1:
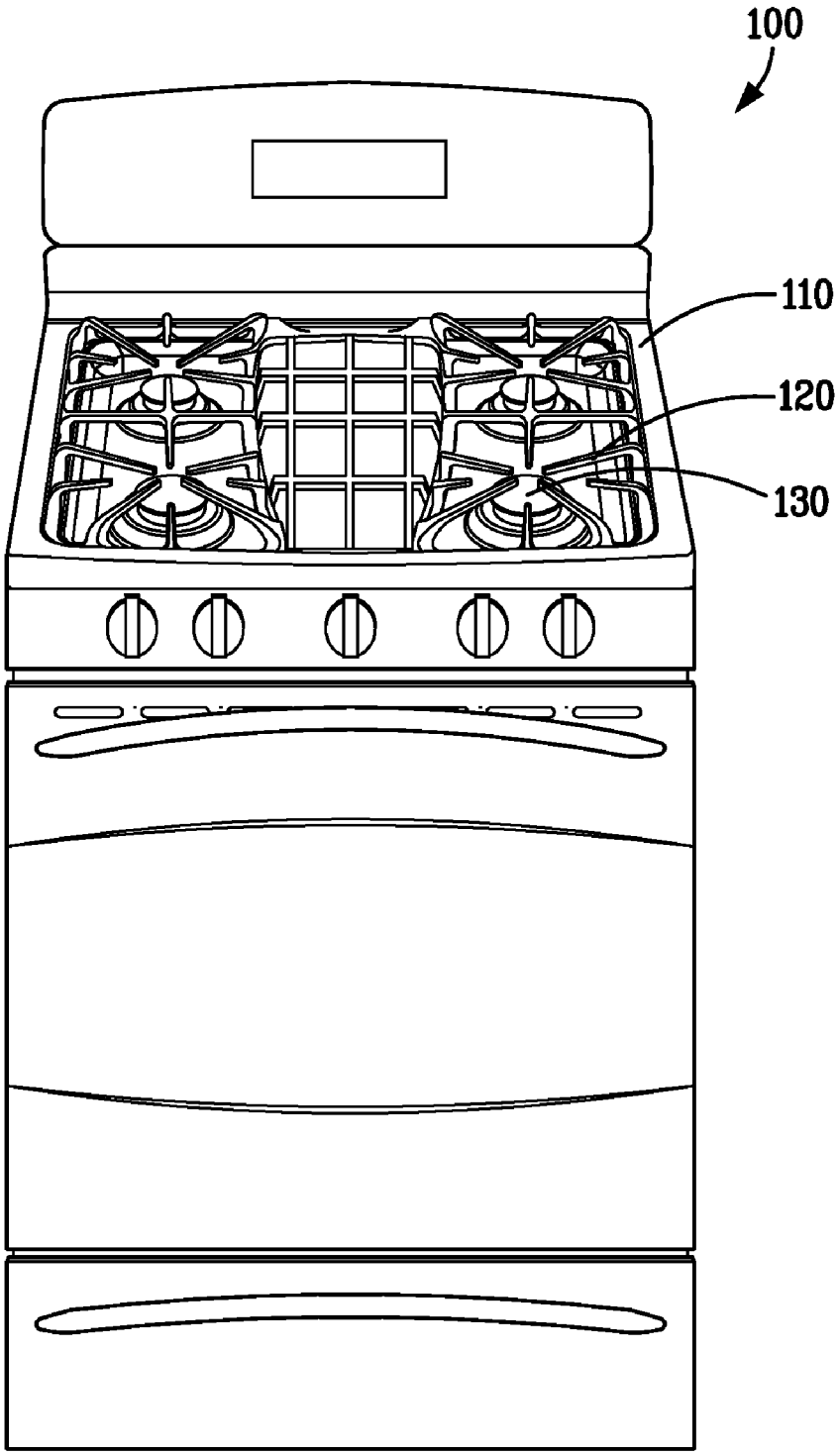
FIG. 1 is a schematic illustration of a cooking appliance incorporating features of the exemplary embodiments.

In one exemplary embodiment, referring to FIG. 1 a cooking appliance 100 is provided. Although the embodiments disclosed will be described with reference to the drawings, it should be understood that the embodiments disclosed can be embodied in many alternate forms. In addition, any suitable size, shape or type of elements or materials could be used. In the examples described herein, the cooking appliance 100 is configured as a free standing gas range. However, it should be understood that the aspects of the exemplary embodiments may be applied to any suitable cooking appliance having gas burners in a manner substantially similar to that described herein. As used herein the term "gas" refers to a combustible gas or gaseous fuel mixture including, for exemplary purposes only, LP (liquid petroleum) gas or natural gas.

In one aspect, the exemplary embodiments provide a cooking appliance 100 having a cooktop 110. The cooking appliance 100 includes a frame or housing 130 that forms a support for the cooktop 110. Here, the cooktop 110 includes one or more cooking grates 120 for supporting cooking utensils on the cooktop 110 and one or more burner assemblies 130 disposed substantially beneath each cooking grate 120. The burner assemblies 130 are attached to the cooktop 110 beneath a respective cooking grate 120 in any suitable manner. For example, the burner body 200 shown in FIG. 2 may rest directly on the cooktop 110 surface or upon a gasket (not shown) that in turn rests upon the cooktop 110 surface.

Figure 2A:
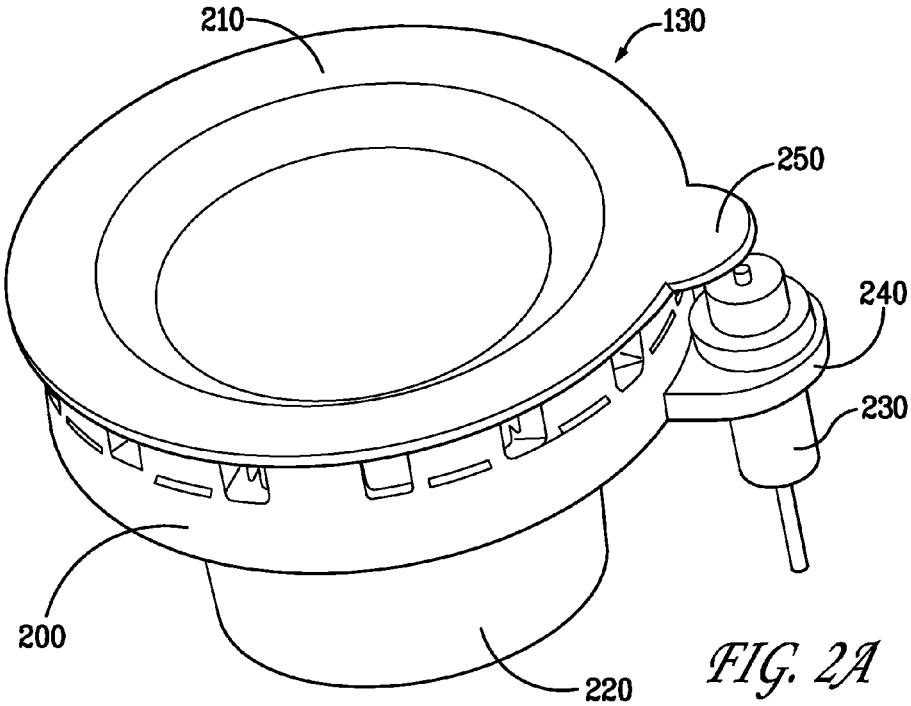
FIGS. 2A-2C are schematic illustrations of an exemplary gas burner assembly in accordance with an exemplary embodiment.
Figure 2B:
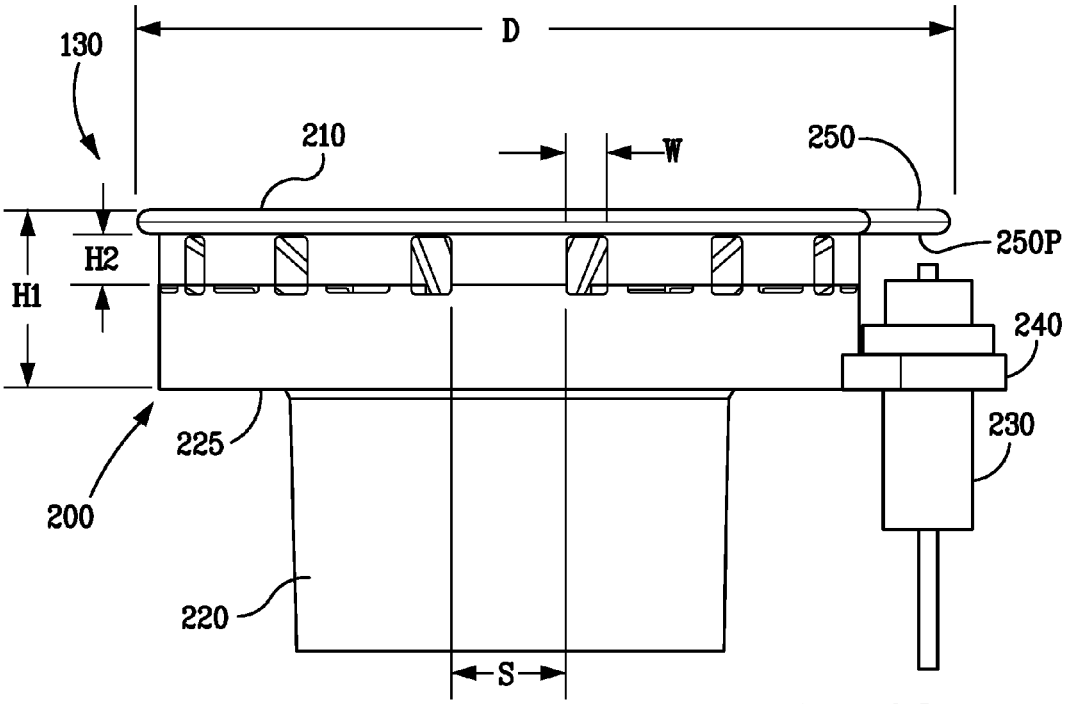
Figure 3:
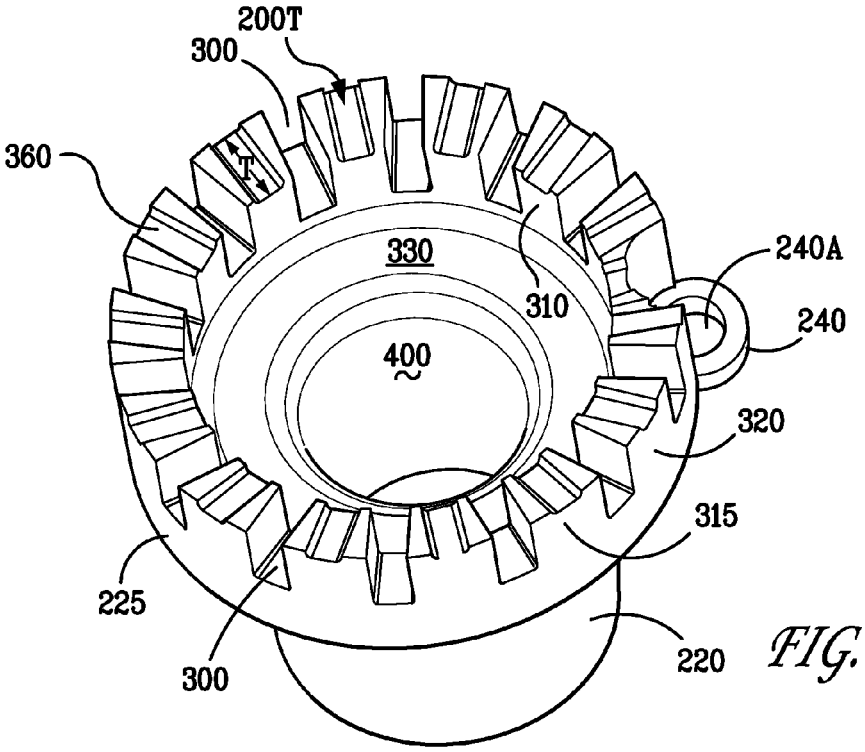
FIG. 3 is a schematic illustration of a portion of the burner assembly of FIGS. 2A and 2B.
Figure 4:
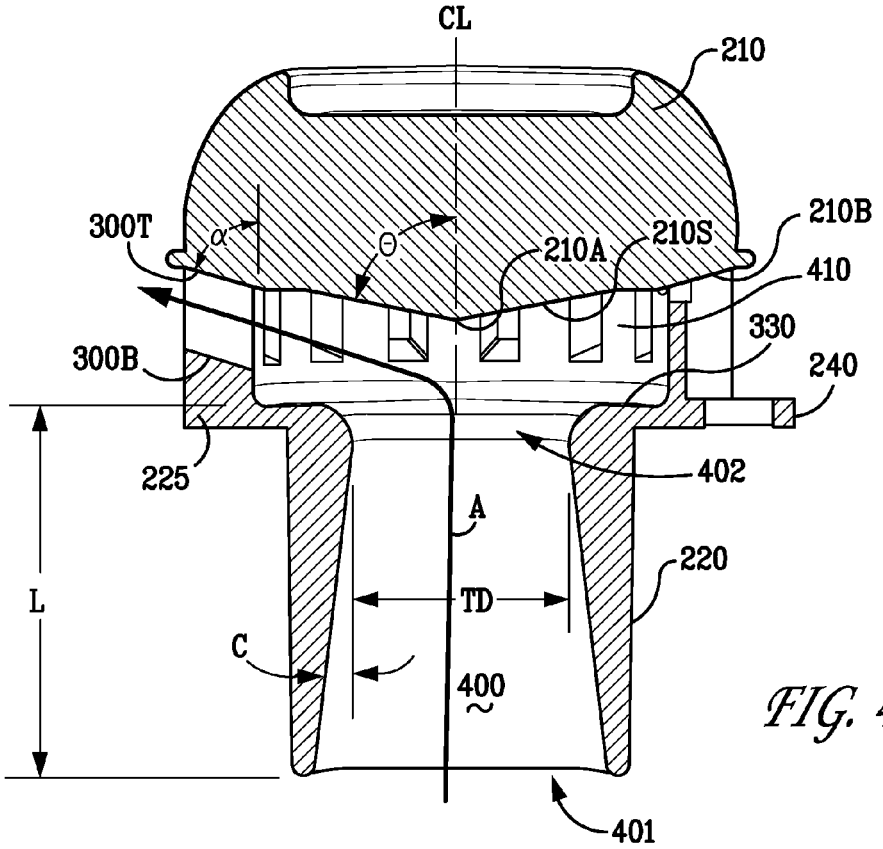
FIG. 4 is a cross sectional view of a burner assembly in accordance with an exemplary embodiment.

Referring to FIGS. 2A and 2B each of the burner assemblies 130 includes a burner body 200 and a burner cap 210. In accordance with the exemplary embodiments, the burner is a small diameter burner having a compact height. In one example, the burner assembly 130 may have an outer diameter D of about two inches and a height H1 of about 0.5 inches. In alternate embodiments the burner may have any suitable diameter and height for obtaining the high efficiencies and meeting industry regulations as described herein. Referring also to FIGS. 3 and 4, the body 200 includes a base portion 225, a cylindrical outer side wall 320, an inner side wall 310 and an inner shelf 330. The cylindrical outer side wall 320 extends axially from the periphery of the base portion 225. The inner side wall 310 is spaced apart from the outer side wall 320 by any suitable distance (e.g. a thickness T of the burner wall 215) and is substantially concentric with the outer side wall 320. The inner shelf 330 extends between the inner side wall 310 and a ventur 400 that passes through the burner body 200. A main gas conduit 220 extends axially from the base portion 225 in a direction substantially opposite the cylindrical side wall 320. The main gas conduit 220 is open to the exterior of the burner body 200 and includes an entry area 401 distal to the inner shelf 330 and a burner throat region 402 proximate the inner shelf 330 that defines the venturi 400 which extends axially substantially through the center of the burner body 200 to provide air/fuel flow along the path A through the burner assembly 130.

The ventur 400 may have any suitable dimensions/features to accommodate the length and number of stages of the venturi 400 for improving the primary air entrainment percentage passing through the main gas conduit 220 when compared to, for example, conventional gas burner assemblies. In one example, the venturi 400 is a single stage venturi having a throat diameter TD in the range of approximately 0.75 inches to 1.0 inches, a length L in the range of approximately 1.25 inches to 2.0 inches, an injet gap in the range of approximately 0.25 inches to 0.50 inches and a convergence angle C of about 10 degrees. The aspects of the disclosed embodiments generally provide the greatest in entitlement in high primary air entrainment for a single orifice. In another example, the ventur 400 may have a throat diameter TD of about 1.0 inch and injet gap of about 0.75 inches. In still other examples, the ventur 400 may have a throat diameter TD of about 0.75 inches and a length L of about 1.25 inches. In this example, the venturi 400 provides about 12,000 Btu/hr at about 4 to about 5 inches of water column pressure. The physical parameters of the venturi 400 can increase the maximum entitlement of the venturi section such that it approaches a primary air entrainment percentage of about eighty percent given the about 12,000 Btu/hr gas jet being supplied to the burner assembly 130.

Figure 5A:
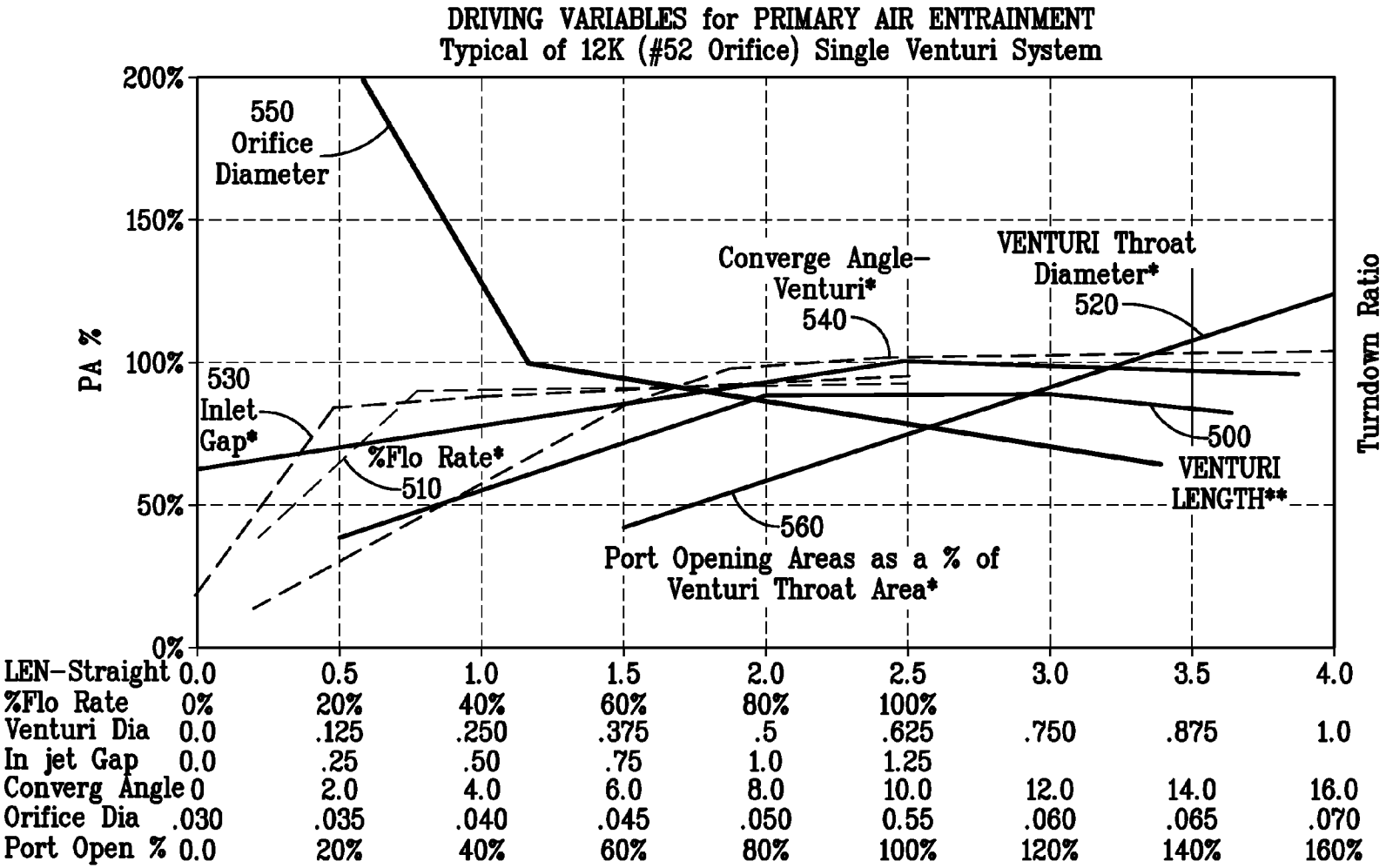
FIGS. 5A and 5B are graphs illustrating variables affecting primary air entrainment of the burner assembly of FIGS. 2A and 2B.
Figure 5B:
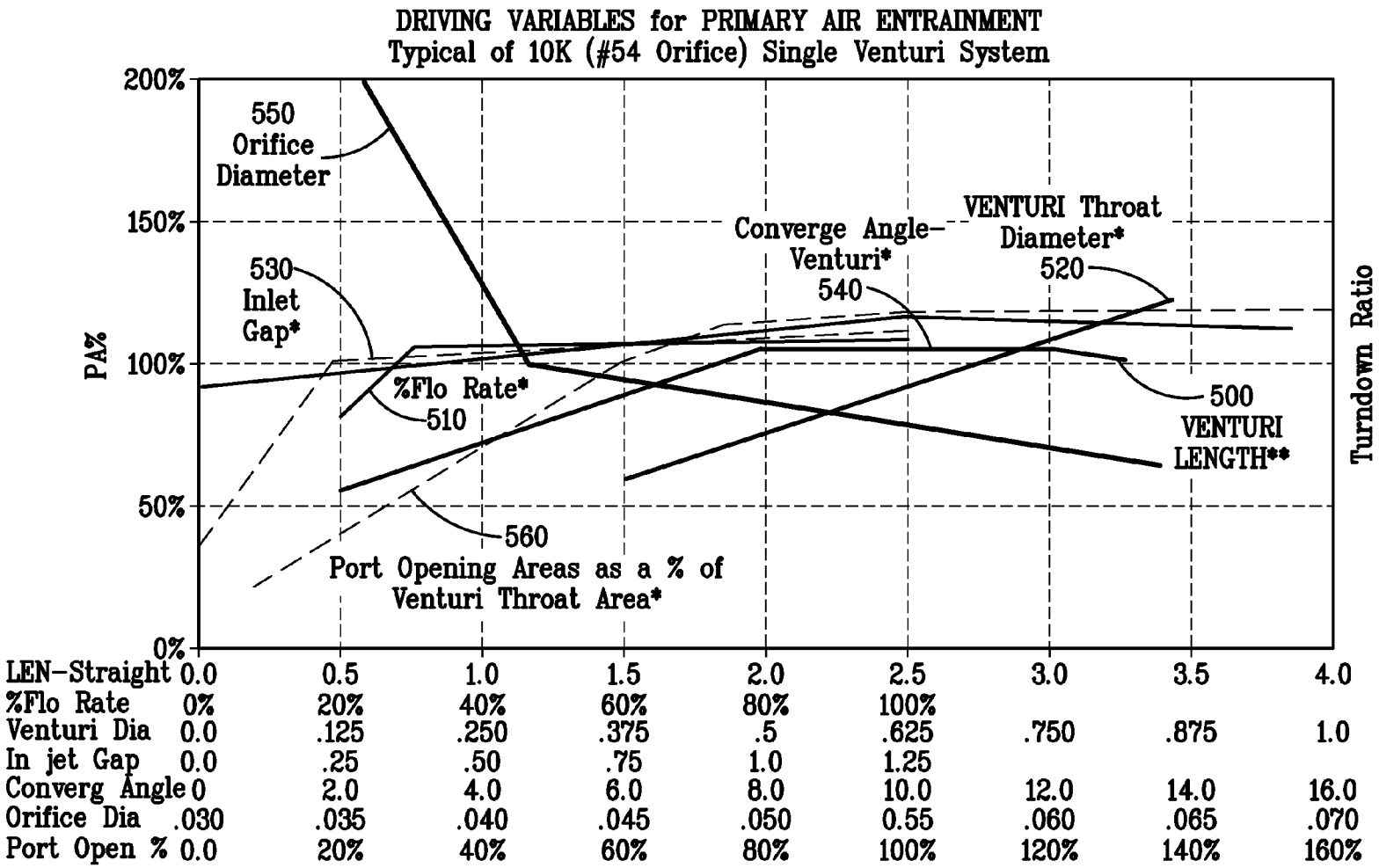

Referring also to FIGS. 5A and 5B empirical curves illustrating the impact of various parameters on primary air entrainment are respectively shown for a 12,000 Btu/hr (#52 orifice) single venturi system and a 10,000 Btu/hr (#54 orifice) single venturi system. These parameters include venturi length (LEN-straight) 500, which is shown in FIG. 5A with respect to a #52 orifice with a 0.5 inch injet gap and straight venturi and in FIG. 5B with respect to a #54 orifice with a 0.5 inch injet gap and straight venturi. Other parameters include overall throttle flow rate as a percentage of maximum rated flow rate (% Flo Rate) 510, venturi throat diameter (venturi dia) 520, injet gap (In jet Gap) 530, convergence angle of the venturi inlet (Converge Angle) 540, and overall port opening area as a percentage of venturi throat area (Port Open %) 560 which are shown in FIG. 5A with respect to a #52 orifice having a 0.75 inch long diameter venturi and in FIG. 5B with respect to a #54 orifice having a 0.75 inch long diameter venturi. Gas orifice diameter (Orifice Dia) 550 is also shown in FIGS. 5A and 5B. It is noted that some trends such as the venturi inlet convergence angle 540 tend to diminish with the presence of other variables such as venturi length 500. Temperature of the venturi 400 and obstacles that drive up back pressure within the burner assembly 130 also have an adverse impact on the primary air entrainment percentage. As can be seen in FIGS. 5A and 5B the air entrainment of the burner assembly 130 (FIG. 2A-2C) increases as a total burner port area approaches, is substantially equal to or exceeds a cross-sectional area of the venturi throat region 402 (FIGS. 2C and 4).

It is noted that pressure losses through the burner assembly 130 should be minimized. These pressure losses may reduce the percentage of primary air entrainment of the gas flow passing through the venturi. To minimize pressure losses through the burner assembly 130, in one embodiment, the burner assembly 130 includes a cap 210 having an interior conical surface 210S and relatively large burner ports 300. Still referring to FIGS. 2A-4 the cap 210 is disposed over the top of the burner body 200 to define a fuel chamber 410 with inner side wall 310 and inner shelf 330 of the burner body 200. Here, the cap includes a conical interior surface 210S whose apex 210A is substantially disposed along the centerline CL of the cap 200. The cap 200 is configured such that the apex 210A of the conical interior surface 210S substantially faces the ventur 400 of the burner body 200. The conical interior surface 210S may have any suitable angle θ so that the creation of turbulent flow eddies which act as pressure loss generators are substantially eliminated. Satisfactory results have been achieved in the exemplary burner with angle θ on the order of about 18 degrees.

Referring again to FIGS. 2A-5B the burner port 300 opening area should be at least equal to about 100 percent of the venturi throat area to reach full primary air entrainment entitlement of the venturi 400. However, when using small diameter utensils or cookware, the flow rate of the burner assembly 130 should be reduced to rates low enough to provide desirable simmer performance without reducing the overall gas/air flow out of the ports to below the flame velocity. In accordance with the exemplary embodiments, the burner ports 300 are sized and spaced so that an outer diameter of the burner is minimized while substantially avoiding flame coalescing and excessive pressure losses, which would adversely affect primary air entrainment. Sizing and spacing the burner ports so that the outer diameter of the burner is minimized provides a balance between full primary air entrainment entitlement of the venturi 400 and a stable simmer rate such that the primary air entrainment percentage of the venturi is about seventy-five percent. In alternate embodiments the primary air entrainment percentage may be more or less than about seventy-five percent. In one example, the burner assembly 130 has about fourteen burner ports 300 in the form of slots or grooves extending through one or more of the burner body 200 and cap 210. In alternate embodiments there may be more or less than fourteen burner ports. It is noted that the number of burner ports may be dependent on the size and spacing of the burner ports.

Figure 2C:
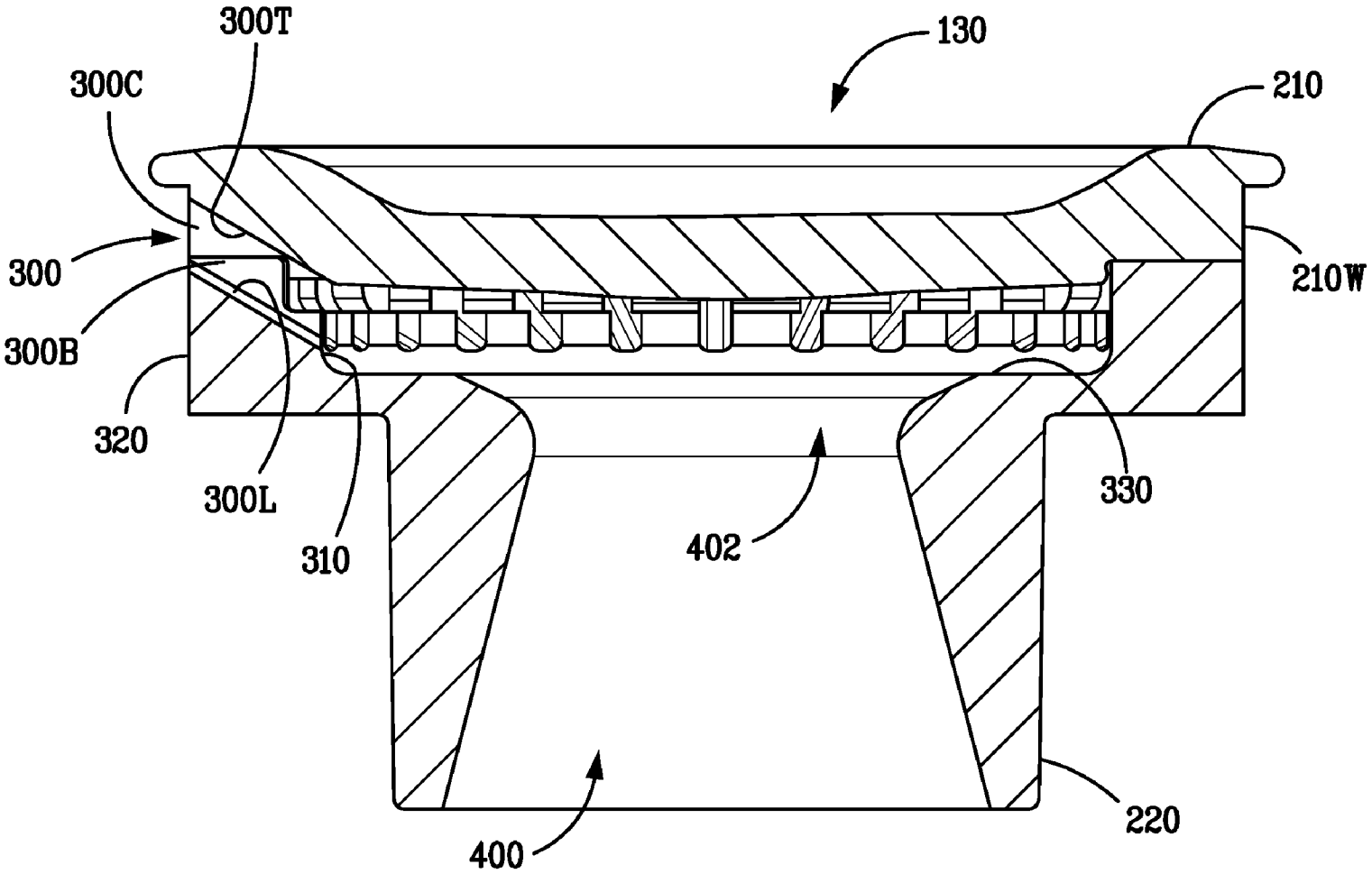

In one exemplary embodiment, a portion of each burner port 300 may extend between the inner side wall 310 and outer side wall 320 of the burner body 220 while another corresponding portion of each burner port 300 extends through an outer peripheral wall 210W of the cap 210 as shown in FIGS. 2B and 2C. In other words, the burner body 220 forms a first portion 300B of the burner port 300 and the cap 210 forms a second portion 300C of the burner port 300.

The first portion 300B formed by the burner body 220 includes a bottom surface 300L of the burner port 300 and the second portion 300C formed by the cap 210 includes a top surface 300T of the burner port 300.

In another exemplary embodiment the cap 210 may form only a top of the burner ports 300 while the sides and bottom of the burner ports are formed in the burner body 200 as shown in FIG. 3 and FIG. 4. In alternate embodiments the burner body 200 may form only a bottom of the burner ports while the sides and tops of the burner ports are formed in the cap 210. The bottom 300B (formed by the burner body 200) and top 300T (formed by the conical interior surface 210S of the cap 210) of each burner port 300 may be disposed at an angle $\alpha$ (relative to the centerline CL of the cap 210) to substantially prevent turbulent flow eddies being formed adjacent the burner ports 300. In one example, the angle $\alpha$ may be substantially the same as angle $\theta$ of the conical interior surface 210S of the cap 210. In alternate embodiments angle $\alpha$ may be more or less than the angle $\theta$ for substantially preventing the creation of turbulent flow eddies. In this example, each of the burner ports are shown as having a substantially rectangular cross section having a width W of about 0.14 inches and a height H2 of about 0.3 inches for providing a stable simmer rate of about 1,800 Btu/hr. The spacing S between the burner ports 300 is about 0.25 inches or larger to substantially prevent the coalescing of flames from each of the burner ports 300. In other examples, there may be any suitable number of burner ports 300 having any suitable cross section, width, height and/or spacing. The size of and spacing between the burner ports 300 according to the disclosed embodiments allows for a small diameter burner assembly 130 whose efficiency is further increased as the flame from the burner assembly 130 is more focused beneath smaller sized utensils placed on a respective cooking grate 120 such that a greater amount of heat is deposited under the utensil.

As can be seen in FIGS. 2A-4 an igniter 230 is attached to the burner body 200 for interfacing with a portion of the cap 210. In one embodiment, the burner body 200 includes an igniter mount 240 that extends radially from the base portion 225. The igniter mount 240 may have any suitable shape and size for holding the igniter 230. In this example, the igniter mount 240 includes an aperture 240A suitably sized so that the igniter may be inserted through the aperture 240A for affixing the igniter 230 to the burner body 200. The cap 210 may also include an igniter interface 250 that extends radially from, for example, a top of the cap 210. The igniter interface 250 may have any suitable shape and size for interfacing with the igniter 230. Here the igniter interface 250 includes an igniter interface protrusion 250P that extends towards the igniter 230 when the cap is placed on the burner body 200. The igniter interface protrusion 250P facilitates the generation of a spark between the igniter 230 and the igniter interface 250 when an electrical charge is applied to the igniter for igniting the fuel passing out of the burner ports 300. It is noted that the cap 210 and burner body 200 may be "keyed" to each other so that the igniter interface protrusion 250P and the igniter 230 can be aligned for operation. In one example, a top 200T of the burner body 200 may include one or more key grooves 360. A bottom 210B of the cap 210 may include corresponding grooves (not shown) configured to interact with the key grooves 360 for orienting the cap 210 relative to the burner body 200 in a predetermined orientation for the alignment of the igniter interface protrusion 250P and the igniter 230.

Figure 6:
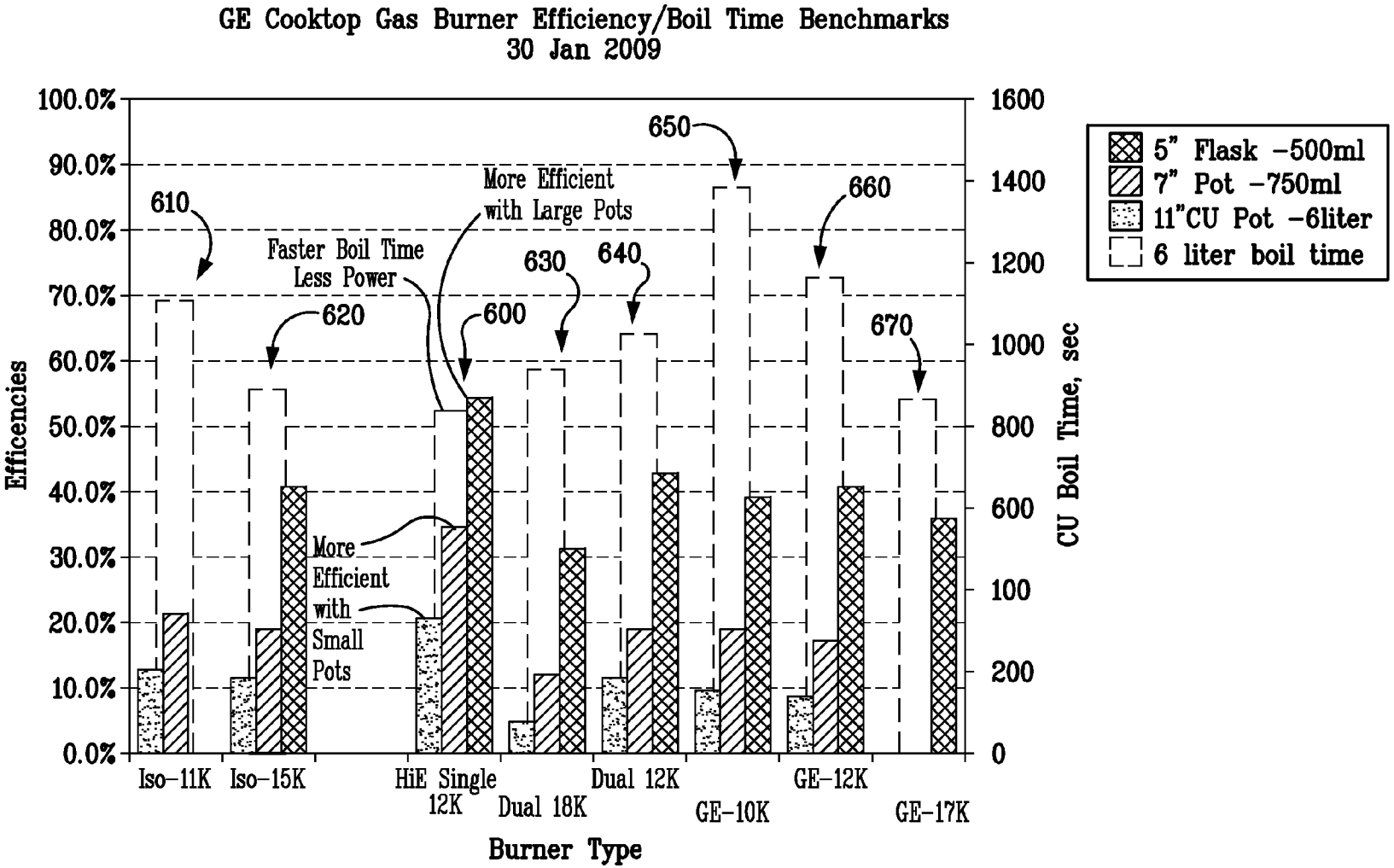
FIG. 6 is a graph illustrating a comparison of efficiencies and boil times of the burner of FIGS. 2A and 2B to conventional gas burners.

The burner assembly 130 of the exemplary embodiments may have an efficiency in the range of approximately 50% to 55% at about a 12,000 Btu/hr rating. This efficiency allows the burner assembly to boil, for example, 6000 ml of water in an eleven-inch diameter Consumer Union standard pot in less time than, for example, larger conventional burners as shown in FIG. 6. The graph in FIG. 6 illustrates a comparison of burner efficiencies, burner types and boil times. It is noted that with smaller diameter pots, such as for example, a 750 ml Consumer Union standard pot the efficiency difference becomes more pronounced due to the tighter, more compact flame pattern of the burner assembly 130 of the exemplary embodiments. As can be seen in the of FIG. 6, the efficiencies 600 of the burner assembly 130 of the exemplary embodiments (labeled HiE Single in FIG. 6) are greater with respect to a five-inch flask, a seven-inch pot and the eleven-inch Consumer Union standard pot described above when compared to the efficiencies 610, 620 of ISO 11,000 Btu/hr and 15,000 Btu/hr burners, the efficiencies 630, 640 of dual 12,000 Btu/hr and 18,000 Btu/hr burners, and the efficiencies 650, 660, 670 of GE 10,000 Btu/hr, 12,000 Btu/hr and 17,000 Btu/hr burners. For illustrative purposes only, the term "ISO" in FIG. 6 refers to burners supplied by the Isophroding company of Germany. The term "Dual" in FIG. 6 refers to the General Electric dual stack burners produced by the Defendi company of Italy. The term "GE" in FIG. 6 refers to General Electric Company burners presently incorporated in gas ranges and cooktops commercially available from the General Electric Company.

The exemplary embodiments described herein provide a high efficiency small diameter burner assembly 130 having a burner body 200, a cap 210 and a reliable source of ignition (e.g. igniter 230) for igniting the fuel flowing through the burner assembly 130. The burner body 200 and cap 210 include features that enhance the overall burner efficiency to deliver heat to a cooking utensil resting on a respective cooking grate 120 substantially without flames from the burner wrapping around a side of the cooking utensil. The higher primary air entrainment percentage of the exemplary embodiments also allows the cooking grates 120 (FIG. 1) to be placed closer to the surface of the cooktop 110 (e.g. relative to the burner flame) because the need to provide secondary air flow paths is substantially reduced. The smaller diameter of the burner assembly 130 allows for a tighter (e.g. smaller diameter) flame pattern that provides more flame engagement with the cooking utensils placed on a cooking grate 120 above the burner assembly 130. This allows the burner assembly 130 to be used at substantially full power with small diameter consumer pots.

Thus, while there have been shown and described and pointed out fundamental novel features of the invention as applied to the exemplary embodiments thereof, it will be understood that various omission and substitutions and changes in the form and details of devices illustrated, and in their operation, may be made by those skilled in the art without departing from the spirit of the invention. For example, it is expressly intended that all combinations of those elements and/or method steps, which perform substantially the same way to achieve the same results, are with the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cooking appliance comprising:

a cooktop; and a gas burner disposed at least partly on the cooktop, the gas burner including, a burner body including a base portion comprising an outer side wall extending axially from a base of the base portion, an inner side wall and an inner shelf, the inner shelf extending from the inner side wall to a venturi passing through the burner body and defining a contoured throat region of the venturi, a cross-section of the contoured throat region being smaller relative to an increasing cross-section of the venturi distal to the contoured throat region; and a cap disposed on the side wall, the cap including a substantially conical interior surface facing the base portion, the substantially conical interior surface being configured to substantially eliminate creation of turbulent flow eddies in gaseous fuel mixture passing, through the gas burner.

2. The cooking appliance of claim 1, wherein the gas burner further comprises a plurality of burner ports extending through at least one of the side wall and cap, the plurality of burner ports being sized and spaced to minimize an outer diameter of the at least one gas burner.

3. The cooking appliance of claim 2, wherein each burner port includes a top surface and a bottom surface, the top surface and the bottom surface being disposed at an angle relative to the outer side wall where the angle of the top surface and the bottom surface is substantially equal to an angle of the substantially conical interior surface relative to a centerline of the cap.

4. The cooking appliance of claim 2, wherein the gas burner further comprises a main gas conduit extending from the base portion opposite the side wall, the main gas conduit including the venturi, and wherein the contoured throat region of the venturi has a throat diameter between about 0.75 inches and about 1.0 inches where an overall port opening area of the plurality of burner ports is a predetermined percentage of an area of the throat diameter such that the primary air entrainment percentage of the venturi is about seventy-five percent.

5. The cooking appliance of claim 2, wherein a diameter of the gas burner is about 2 inches and spacing between each of the plurality of burner ports is a minimum of about 0.25 inches.

6. A gas burner for a cooking appliance, the gas burner comprising:

a burner body including a base portion comprising an outer side wall extending axially from a base of the base portion, an inner side wall and inner shelf, the inner shelf extending from the inner side wall to a venturi passing through the burner body and defining a contoured throat region of the venturi, a cross-section of the contoured throat region being smaller relative to an increasing cross-section of the venturi distal to the contoured throat region;

a cap disposed on the outer side wall to form a fuel chamber within the burner body; and a plurality of burner ports extending through at least one of the side wall and the cap, the plurality of burner ports being sized and spaced to minimize an outer diameter of the gas burner.

7. The gas burner of claim 6, wherein each burner port includes a top surface and a bottom surface, the top surface and the bottom surface being disposed at an angle relative to the our side wall.

8. The gas burner of claim 7, wherein the cap includes a substantially conical interior surface facing the base portion, the substantially conical interior surface being configured to substantially eliminate creation of turbulent flow eddies in a gaseous fuel mixture passing through the gas burner.

9. The gas burner of claim 8, wherein the angle of the top and bottom surface is substantially equal to an angle of the substantially conical interior surface relative to a centerline of the cap.

10. The gas burner of claim 6, further comprising a main gas conduit extending from the base portion opposite the side wall, the main gas conduit including the venturi, the contoured throat region of the venturi having a throat diameter in the range of approximately 0.75 inches to 1.0 inch.

11. The gas burner of claim 10, wherein an overall port opening area of the plurality of burner ports is a predetermined percentage of an area of the throat diameter such that the primary air entrainment percentage of the venturi is about seventy-five percent.

12. The gas burner of claim 6, wherein a diameter of the burner is about 2 inches and spacing between each of the plurality of burner ports is a minimum of about 0.25 inches.

13. The gas burner of claim 6, further comprising an igniter coupled to the burner body, the igniter being configured to interface with a surface of the gas burner for igniting the gaseous fuel mixture exiting the plurality of burner pons.

14. A gas burner for a cooking appliance, the gas burner comprising:

a burner body including a base portion comprising an outer side wall extending axially from a base of the base portion, an inner side wall and an inner shelf;

a venturi passing through the burner body, the inner shelf of the burner body extending from the inner side wall to the venturi and defining a contoured throat region of the venturi, a cross-section of the contoured throat region being smaller relative to an increasing cross-section of the venturi distal to the contoured throat region;

a cap disposed on the outer side wall, the cap being defined by an outer peripheral wall and an inner peripheral wall, the cap including, a substantially conical interior surface facing the base portion, the substantially conical interior surface being configured to substantially eliminate creation of turbulent flow eddies in a gaseous fuel mixture passing, through the gas burner;

a plurality of burner ports defined in the burner body and the cap, a portion of each burner port extending through the outer side wall and the inner side wall of the burner body and a corresponding portion of each burner port passing through the outer peripheral wall of the cap, and wherein a total burner port area formed by each of the plurality of burner ports is approximately equal to or exceeds the cross-section of the contoured throat region of the venturi.

15. The gas burner of claim 14, wherein the burner ports are sized and spaced to minimize an outer diameter of the gas burner.

16. The gas burner of claim 15, wherein each burner port includes a top surface and a bottom surface, the top surface and the bottom surface being disposed at an angle relative to the outer side wall.

17. The gas burner of claim 16, wherein the angle of the top and bottom surface is substantially equal to an angle of the substantially conical interior surface relative to a centerline of the cap.

18. The gas burner of claim 14, further comprising a main gas conduit extending from the base portion opposite the side wall, the main gas conduit including the venturi, and wherein the contoured throat region of the venturi has a throat diameter between about 0.75 inches and about 1.0 inches.

19. The gas burner of claim 18, wherein the total burner port area is a predetermined percentage of an area of the throat diameter such that the primary air entrainment percentage of the venturi is about seventy-five percent.

20. The gas burner of claim 14, further comprising an igniter coupled to the burner body, the igniter being configured to interface with a surface of the gas burner for igniting the gaseous fuel mixture exiting the gas burner.

* * * * *